US006026960A

United States Patent [19]

Cogliano

[11] Patent Number: 6,026,960

[45] Date of Patent: Feb. 22, 2000

[54] ANIMAL ART CASE

[76] Inventor: Mary Ann Cogliano, 5565 St. Francis Cir., Loomis, Calif. 93650

[21] Appl. No.: 09/363,016

[22] Filed: Jul. 29, 1999

Related U.S. Application Data

[60] Provisional application No. 60/095,050, Jul. 31, 1998.

[51] Int. Cl.[7] ..... B65D 85/00

[52] U.S. Cl. ..... 206/575; 206/457

[58] Field of Search ..... 206/575, 579, 206/224, 214, 371, 457; 220/4.26, 4.27, 23.83

[56] References Cited

U.S. PATENT DOCUMENTS 5,551,569 9/1996 Garvin-Mazzarisi ..... 206/457 X 5,878,931 3/1999 Morphet ..... 206/457 X

*Primary Examiner*—Jacob K. Ackun

*Attorney, Agent, or Firm*—Hoffman, Wasson & Gitler, PC

[57] ABSTRACT

A carrying case for art supplies particularly used by children. The carrying case, when closed depicts an animal or other fanciful character. When opened, the carrying case includes a base section as well as two top foldable sections, each section provided with at least one compartment for the storage of art supplies. One of the top foldable sections includes a block provided with a plurality of holes into which art pencils are held when the carrying case is in the opened position. The block is hinged and will rotate into a closed position when the carrying case is in the closed position.

11 Claims, 2 Drawing Sheets

ANIMAL ART CASE

This application claims the benefit of U.S. Provisional Application Ser. No. 60/095,050 filed Jul. 31, 1998.

FIELD OF THE INVENTION

The present invention is directed to a transportable art case designed to meet the needs of a child, an amateur artist or even the most serious of artists.

BACKGROUND OF THE INVENTION

From prehistoric times, human beings have always had a need to express themselves in various forms. Cavemen all across the world from Europe, Asia and Australia provided many drawings on the walls of caves illustrating the many facets of their lives, such as the types of animals which inhabited their environment. Drawing, as a serious art form gained popularity among European artists during the 1400s when paper first became generally available. Since then, each century has produced artists who have created great drawings.

However, one need not be a great artist to enjoy the art of drawing. Many individuals have found that drawing, as a hobby, relaxes them and allows them a greater appreciation of the many artists who currently display their works as well as artists who have preceded them. Although it is true that anyone, at any age, can begin to appreciate art, it is also true that the earlier one introduces children to the art of drawing, the more likely they will appreciate art when they become older, both as artists or as viewers of art. Many parents, realizing the importance of art to a child, have purchased art supplies for their children, such as a set of colored pencils, a set of crayons, watercolors, or the like. However, without a proper means of storing these art supplies, they often become lost or scattered among the children's other toys and diversions. Additionally, these art supplies can become unwieldy if one wishes to take them to a location away from home, such as a vacation in order to sketch or paint at different locales and attractions.

Therefore, it is apparent that a carrying case for art supplies should be developed allowing these art supplies to be easily transported as well as retained in a single location. Additionally, it is important that the traveling case have an appearance which would be pleasing to a child and therefore would more likely encourage the child to utilize the various art supplies provided therein.

SUMMARY OF THE INVENTION

The present invention overcomes these deficiencies by providing a portable carrying case used primarily by a child. This carrying case would take the form of an animal, cartoon character, television character, or similar diverting appearance which would be pleasing to the child. This case would be provided with various interior storage compartments as well as areas for storing various art supplies. The carrying case would be easily opened as well as closed by a young child and would include a handle or other device for easily transporting the carrying case to various locations.

BRIEF DESCRIPTION OF THE DAWINGS

The above and other objects and advantages of the present invention will become apparent from the following detailed description when read in conjunction with the accompanying drawings wherein.

DESCRIPTION OF THE PREFERRED EMBODIMENTS

Figure 1:
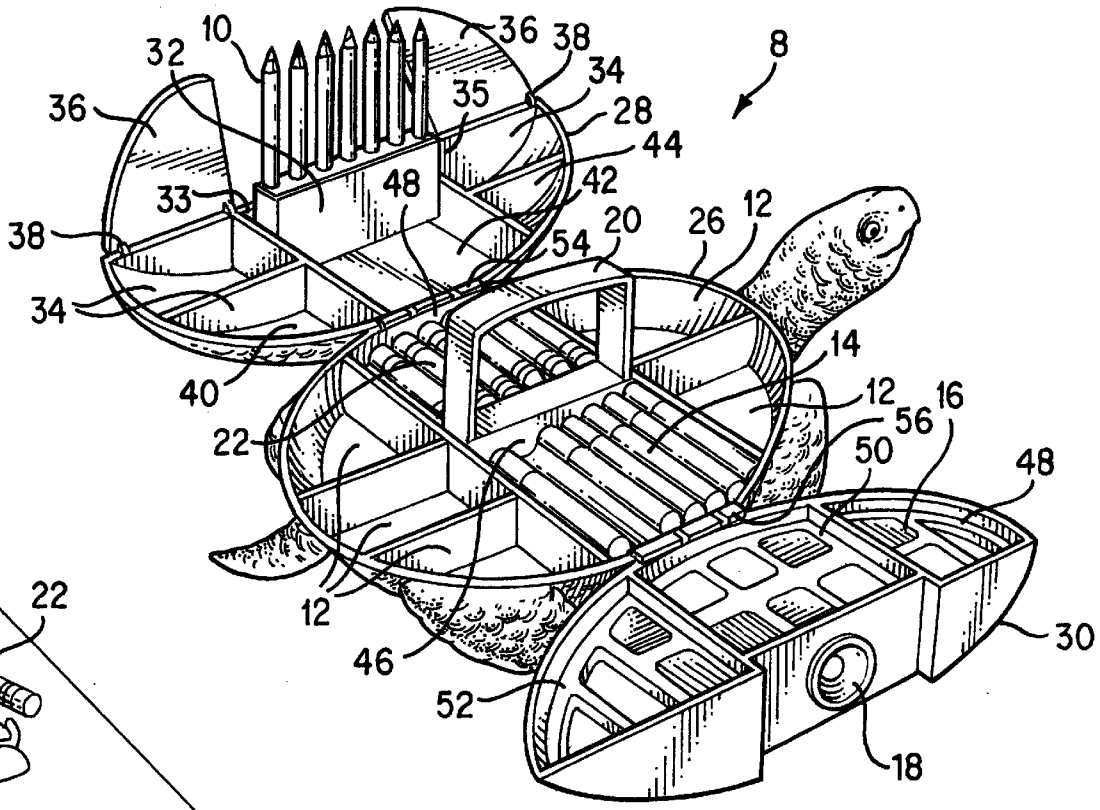
FIG. 1 is a perspective view of the carrying case in the open position.

As illustrated with respect to FIG. 1, the present invention 8 includes a carrying case for various art supplies such as colored pencils 10, various types of markers 14, as well as a storage location for watercolors 16. A pencil sharpener 18 is also provided for sharpening the pencils 10. The exterior design of the art case as shown in the drawings takes the form of a turtle. However, it can be appreciated that the carrying case for artist's supplies can take many forms which would be pleasing to either children, young adults or adults. The outward design of the carrying case can take the form of other animals, insects, prehistoric creatures, such as dinosaurs, or other types of fictional or non-fictional characters.

Figure 2:
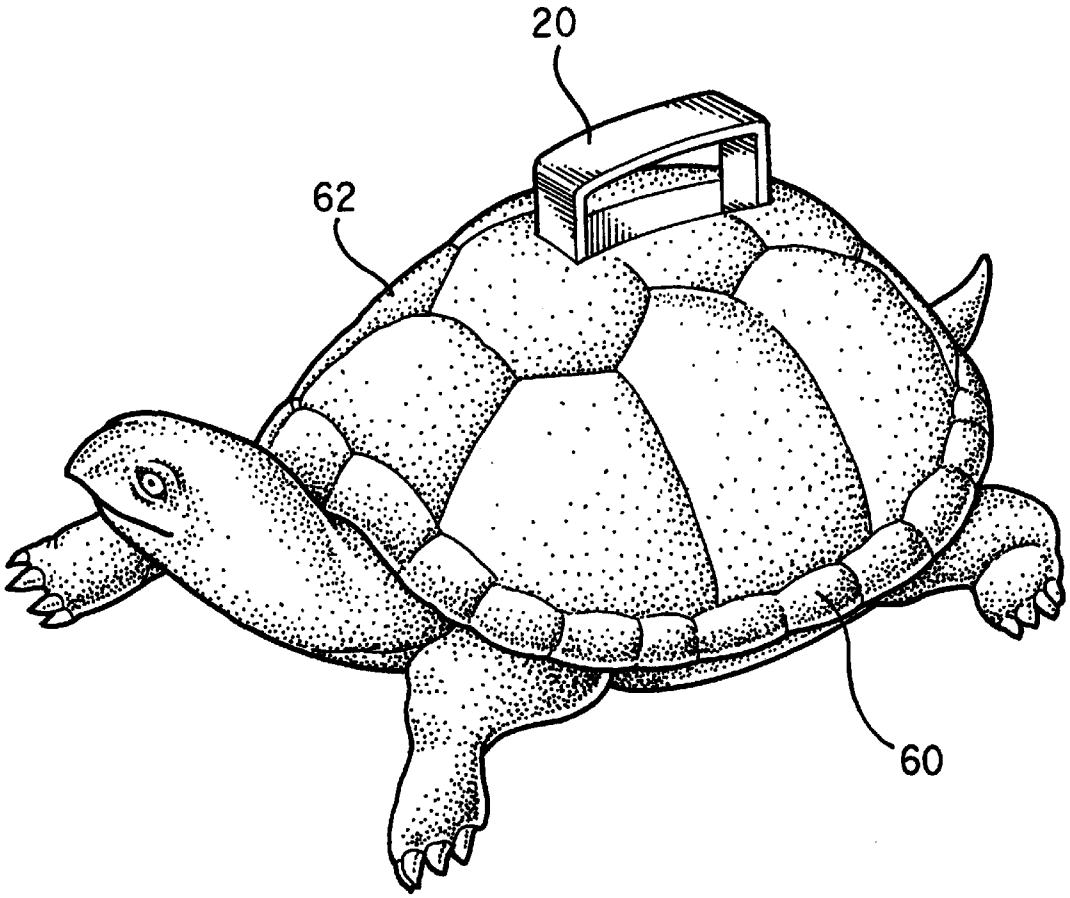
FIG. 2 is a perspective view of the carrying case in the closed position.

When in the form of the turtle, as shown in the drawings, the carrying case would include a base 26 as well as a first foldable top section 28 and a second foldable top section 30. When these sections 28 and 30 are folded upon the base section 26 as shown in FIG. 2 in the closed position, a handle 20 can be used to easily transport the carrying case from place to place. This handle 20 is fixedly attached to the base section 26. Although not specifically illustrated in the drawings, various devices can be utilized to insure that the art case remains in the closed position during transport. For example, various mechanical latching devices or snaps can be used to latch sections 28 and 30 together when the carrying case is in the closed position. Alternatively, Velcro, snaps, magnetic latches and the like can be used to ensure the carrying case remains closed.

Although many configurations can be used to store various items in the carrying case, FIG. 1 does illustrate one embodiment. Section 28 contains an upstanding rectangular block 32 provided with a plurality of holes therein. These holes can be used to store the colored pencils 10 or other types of art supplies therein. Additionally, top section 28 includes two storage sections 34 in which additional supplies such as erasers 24 can be stored. Since section 28 is designed to be rotated inwardly over the bottom section 26 when the carrying case is to be stored, it is important that any of the materials stored in compartments 34 be maintained therein. Therefore, upstanding cover portions 36 are used to cover the top of the storage locations 34 when the carrying case is not in use. Hinges 38 are used to allow the covers 36 to move from the closed position to the open position and vice versa. Additionally, storage compartments 40 and 44 are also shown therein. It is noted that the covers 36 are designed to cover all of these compartments when they are in the closed position. Furthermore, compartment 42 can be used to hold different material or components when the carrying case is in the open position. It should also be noted that the block 32 is also hinged to walls 33, 35 forming the periphery of the compartments 34. Therefore, depending upon the length of the pencils 10, the pencils could be retained in the block 30 when it is to be rotated 90° to the closed horizontal position from the vertical position illustrated in FIG. 1. However, if the length of the pencils are too large, these pencils must be removed from this block 32 and re-inserted into the holes of the block 32, when the carrying case is opened.

The bottom position 26 of the carrying case contains a number of storage compartments 12 in which various elements can also be stored. This section also includes a compartment 46 in which markers 14 are stored as well as a compartment 48 in which crayons 22 are stored. It can be appreciated that these storage compartments can store other elements as well and are not to be limited to the art supplies shown therein.

As illustrated in FIG. 1, section 30 holds a number of watercolor paints 16 in compartments 48, 50, and 52. Obviously, the number and form of these compartments can be altered. Furthermore, a pencil sharpener 18 is also shown in this section. Sections 28 and 30 are connected to the bottom section 26 by hinges 54 and 56 to allow the sections 28 and 30 to be easily opened and closed.

Figure 3:
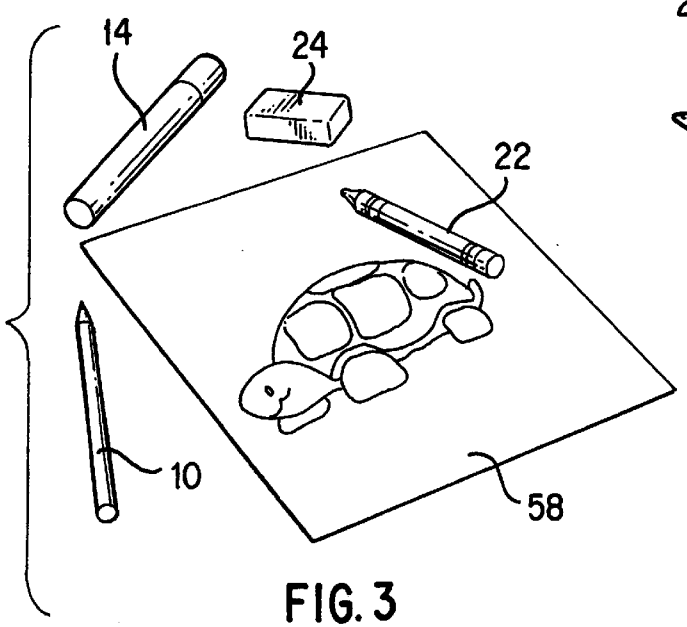
FIG. 3 is a perspective view showing some of the art supplies stored in the carrying case of the present invention.

FIG. 3 illustrates various art supplies, such as a pencil 10, a marker 14, a crayon 22 and an eraser 24 used to draw a picture 58.

As can be appreciated, the present invention has been designed for both the doodler to the serious artist. The case supplies endless imaginative possibilities such as colored pencils, markers, watercolors, crayons, a built-in sharpener, as well as extra storage space. This carrying case and art kit will allow the child's artistic spirit to soar while creating a masterpiece of art.

As previously indicated, when the art case is in the closed position, the first foldable section 28, and the second foldable section 30 would be rotated to cover the bottom portion 30, an outward design would be created taking form of various animals or comic characters, etc. FIG. 2 shows a perspective view of one of these animals, namely a turtle. The top portion 60 would have the look and perhaps the feel of the shell of the turtle when the foldable top section 28 is closed. Similarly, the top section 62 would have the look and perhaps the feel of the shell of the turtle when the foldable top section 30 is closed. Various external features, such as the turtle's head, feet and tail are also shown.

While the present invention has been described with relation to a preferred embodiment, it can be appreciated that various modifications and adaptations thereof would be apparent to those skilled in the art. For example, as indicated herein above, the exterior features of the carrying case can be altered to produce other animals, insects, fictional characters, non-fictional characters, and the like. Additionally, the type and amount of art supplies designed to be housed in the carrying case can be changed, as well as the number and type of storage containers.

What is claimed is:

1. A carrying case for art supplies comprising:

a first storage receptacle for the storage of supplies therein, said first storage receptacle including an exterior surface;

a second storage receptacle hingedly attached to said first storage receptacle for the storage of supplies therein, said second storage receptacle including an exterior surface, said second storage receptacle moveable from a first open position to a second closed position covering a portion of said first storage receptacle; and a third storage receptacle hingedly attached to said first storage receptacle for the storage of supplies therein, said third storage receptacle including an exterior surface, said third storage receptacle moveable from a first open position to a second closed position covering a portion of said first storage receptacle; wherein said exterior surfaces of said first, second and third storage receptacles are provided with animal-type features, thereby creating the appearance of an animal when said second and third storage receptacles are both in the closed position.

2. The carrying case in accordance with claim 1, wherein said animal is a turtle.

3. The carrying case in accordance with claim 1, wherein said second storage receptacle is provided with a plurality of separate storage compartments.

4. The carrying case in accordance with claim 3, further including at least one cover member hingedly attached to said second storage receptacle, said cover members moveable from a first open position to a second closed position covering at least a portion of said separate storage compartments.

5. The carrying case in accordance with claim 1, further including a block member having a plurality of holes therein for retaining art supplies therein.

6. The carrying case in accordance with claim 4, further including a block member having a plurality of holes therein for retaining art supplies therein.

7. The carrying case in accordance with claim 6, wherein said block member is hingedly attached between two of said separate storage compartments moveable between a first open position and a second closed position.

8. The carrying case in accordance with claim 1, provided with a handle fixedly attached to said first storage receptacle.

9. The carrying case in accordance with claim 1, wherein said third storage receptacle is provided with a plurality of water color paints.

10. The carrying case in accordance with claim 7, wherein said third storage receptacle is provided with a plurality of water color paints.

11. The carrying case in accordance with claim 1, further including a pencil sharpener provided in said first, second or third storage receptacle.

* * * * *